United States Patent [19]

Sando et al.

[11] 4,027,507

[45] June 7, 1977

[54] AIR-AND-LIQUID COMBINED SEALING DEVICE FOR HIGH PRESSURE STEAMER

[75] Inventors: Yoshikazu Sando; Hiroshi Ishidoshiro, both of Wakayama, Japan

[73] Assignee: Sando Iron Works Co., Ltd., Wakayama, Japan

[22] Filed: Oct. 3, 1975

[21] Appl. No.: 619,457

[30] Foreign Application Priority Data

Oct. 7, 1974 Japan ..... 49-115301
Feb. 27, 1975 Japan ..... 50-24293

[52] U.S. Cl. ..... 68/5 E; 34/242
[51] Int. Cl.[2] ..... D06B 23/18
[58] Field of Search ..... 68/5 E; 34/242

[56] References Cited

UNITED STATES PATENTS

| | | | |
|---|---|---|---|
| 3,058,327 | 10/1962 | Hablutzel et al. | 68/5 E |
| 3,158,507 | 11/1964 | Alexander | 68/5 E X |
| 3,415,083 | 12/1968 | Okazaki et al. | 68/5 E |

FOREIGN PATENTS OR APPLICATIONS

| | | | |
|---|---|---|---|
| 1,351,732 | 12/1963 | France | 68/5 E |
| 1,460,354 | 4/1969 | Germany | 68/5 E |

*Primary Examiner*—Philip R. Coe

*Attorney, Agent, or Firm*—Toren, McGeady and Stanger

[57] ABSTRACT

The combination of an air sealing device and liquid sealing arrangement including an air pressure chamber and a liquid chamber which are arranged along the incoming and outgoing path lines of a cloth or textile material or the like, the path lines being formed between a plurality of sealing rolls disposed on a drum body of a high pressure steamer and the inside of the drum body. The air pressure inside the air pressure chamber is arranged to be balanced through a water column in the liquid chamber with a high pressure, high temperature steam existing inside the drum body. Further, the air sealing device in combination with the liquid sealing arrangement comprises a seal block arranged to block a penetrating hole with sealing rolls; an air seal cylinder provided for supplying pressure sealing air to the inside of the cylinder through which the penetrating hole is arranged to pass; a liquid seal chamber disposed between the air seal cylinder and an opening provided in the high pressure steamer; and a steam pressure reducing chamber which is provided at one end of the liquid seal chamber and is connected to the opening of the high pressure steamer through a throttle valve. The penetrating hole of the seal block being divided by a partition plate into an air pressure supply passage and a textile material passage.

2 Claims, 2 Drawing Figures

AIR-AND-LIQUID COMBINED SEALING DEVICE FOR HIGH PRESSURE STEAMER

BACKGROUND OF THE INVENTION

This invention relates to the combination of an air sealing device combined with a liquid sealing arrangement for pressure sealing an inlet and an outlet provided for textile products of fibers, tow, cloth, etc. in a high pressure steamer which is used for the high temperature, high pressure steaming treatment of such textile products; the air sealing device which combines air sealing with liquid sealing with a liquid sealing chamber being provided for preventing the sealing air from coming into the high pressure steamer. The inventor of this invention previously developed a pressure sealing arrangement for sealing the inlet and outlet parts of a high pressure steamer with three rolls; and another pressure sealing arrangement wherein air pressure and the internal pressure of the drum body of such a high pressure steamer are balanced with each other through a water column with an air pressure chamber and a water column arranged between sealing rolls and the internal pressure of the drum body. The present invention is an improvement over these previous developments.

SUMMARY OF THE INVENTION

It is an object of this invention to provide a device which improves the conventional devices of the same nature to ensure reliable and safe sealing. The features and advantages of the device of this invention are as follows:

1. The entrance and the exit of the textile products into and out of a high temperature, high pressure steamer are effected at one point; and the surface temperature of the seal roll is lowered to ensure a longer life of the rubber material which forms the surface layer of the seal roll.

2. Air sealing is effected with a rubber roll disposed in the middle part and rolls made of stainless steel disposed on the right and left sides thereof. Thus the air sealing of both the inlet and outlet parts for a textile product is possible with one rubber roll.

3. To keep the temperature of the center rubber roll from rising, an air pressure chamber is arranged in such a manner that, while the pressure is applied to the rubber roll, the chamber serves to prevent the rise of the rubber roll temperature.

4. Between the high temperature and high pressure of the high temperature, high pressure chamber and the air pressure chamber, there is provided a water of liquid chamber, which serves to prevent the flow of the air pressure into the high temperature, high pressure chamber.

5. A textile product passes the inlet part of the seal roll arrangement and is impregnated with a treating liquid inside the drum body. Then the quantity of the impregnating liquid is adjusted to a suitable quantity by means of wringer rolls or by self-pressing dewatering arrangement so that the textile product can be processed with the moisture content thereof increased.

6. Between the outlet part provided in the seal roll arrangement for textile products and the air pressure chamber, the textile product is arranged to pass through a water chamber for washing and reduction in temperature before it goes out through the outlet part provided in the seal roll arrangement.

In short, according to the air sealing device of this invention, inlet and outlet path lines are provided for textile products between the inside of the drum body of a high pressure steamer and a sealing roll arrangement comprising a plurality or rolls disposed on the drum body. Then, with an air pressure chamber and a liquid chamber respectively provided along these inlet and outlet path lines, the air pressure inside the air pressure chamber is balanced against the high temperature, high pressure steam inside the drum body through a water column of the liquid chamber.

The device of this invention will be understood from the detailed descriptionof preferred embodiments given herein in connection with the accompanying drawings, in which:

DESCRIPTION OF THE PREFERRED EMBODIMENTS

EXAMPLE 1

Figure 1:
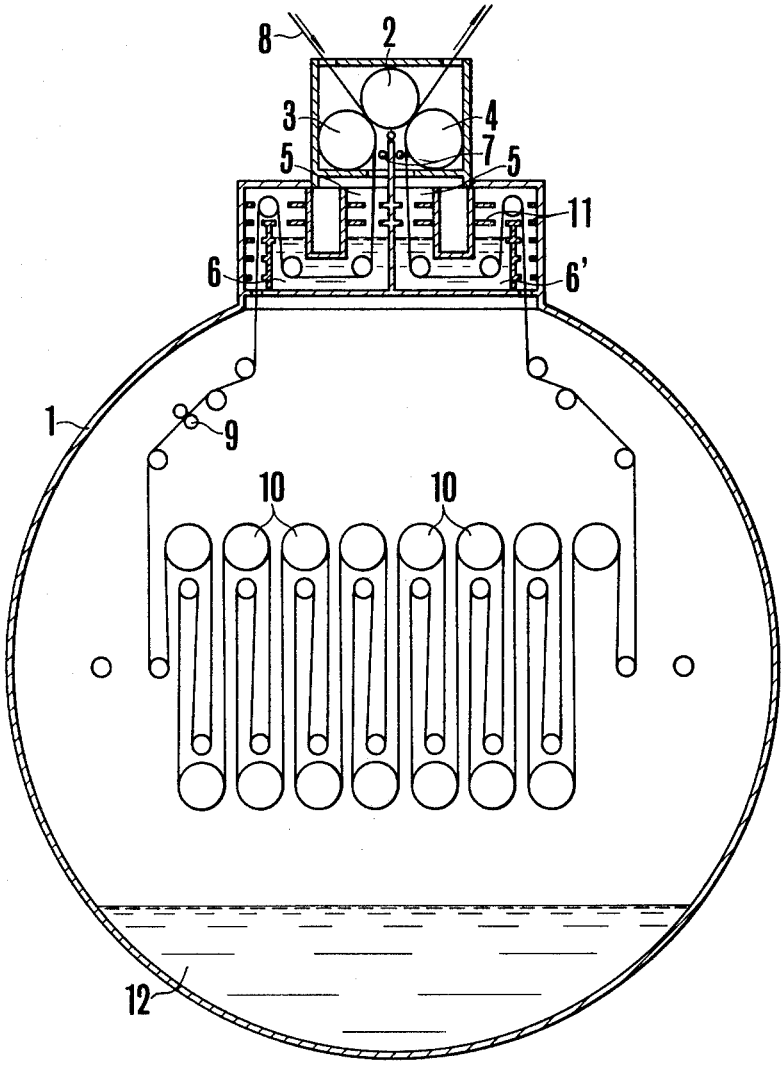
FIG. 1 is a vertically sectional front view illustrating a device embodying the air sealing device of this invention.

In the embodiment illustrated in FIG. 1, a pressure sealing device is arranged on top of a horizontal-type cylindrical drum body 1 of a high pressure steamer in the direction of the bus bar thereof. The pressure sealing device comprises a center rubber roll 2, stainless steel rolls 3 and 4 which are disposed on the left and right sides of the center roll, an air pressure chamber 5 which is disposed to cover both the left and right sides in common, a liquid chamber 6 and a water chamber 6' which are arranged, one on the left side and the other on the right side. An air pressure supply port 7 opens into the air pressure chamber 5 to supply the pressurized air that balances against the internal pressure of the drum body 1. The reference numeral 9 indicates a pair of self-pressing rolls arranged inside the drum body; 10 indicates a group of feed rolls which are arranged in two rows inside the drum body 1; 11 indicates plates which are disposed in a multistage arrangement, for the purpose of buffing the pressure and accelerating air/liquid separation, between the liquid chamber 6, water chamber 6' and the drum body 1 and also between the three sealing rolls 2, 3 and 4, the liquid chamber 6 and the water chamber 6'; and 12 indicates hot water deposited at the bottom of the drum body 1.

The embodiment described in the foregoing operates as follows:

A cloth material (or web) 8 to be treated passes between a nipping part jointly formed by the center rubber roll 2 and the stainless roll 3 to come into the air pressure chamber 5 and further moves into a liquid chamber 6 which is disposed on the left side of the air pressure chamber and is filled with a treating liquid such as a caustic liquid or a dyeing liquid. The cloth web 8 passes the inside of the liquid chamber 6 with the path forming a U shape and the cloth web is guided into the drum body 1. Since the web 8 which in introduced into the drum body 1 as been impregnated with a great amount of the treating liquid through the liquid chamber 6, the web undergoes a dewatering treatment which is effected inside the drum body by means of selfpressing rolls 9 to have a suitable moisture content. Following this treatment, the web further moves on creeping up and down through a group of feed rolls 10 which are disposed in upper and lower rows. The web is thus subjected to a high temperature steaming treatment while creeping in this manner Then, the treated cloth web 8 comes out of the drum body and passes through the water chamber 6' which is disposed on the right side to be washed and cleaned with water there. After washing, the web 8 is introduced into the air pressure chamber 5 and goes to the outside passing between the rubber roll 2 and the stainless steel roll 4 which is disposed on the right side of the rubber roll 2.

EXAMPLE 2

Figure 2:
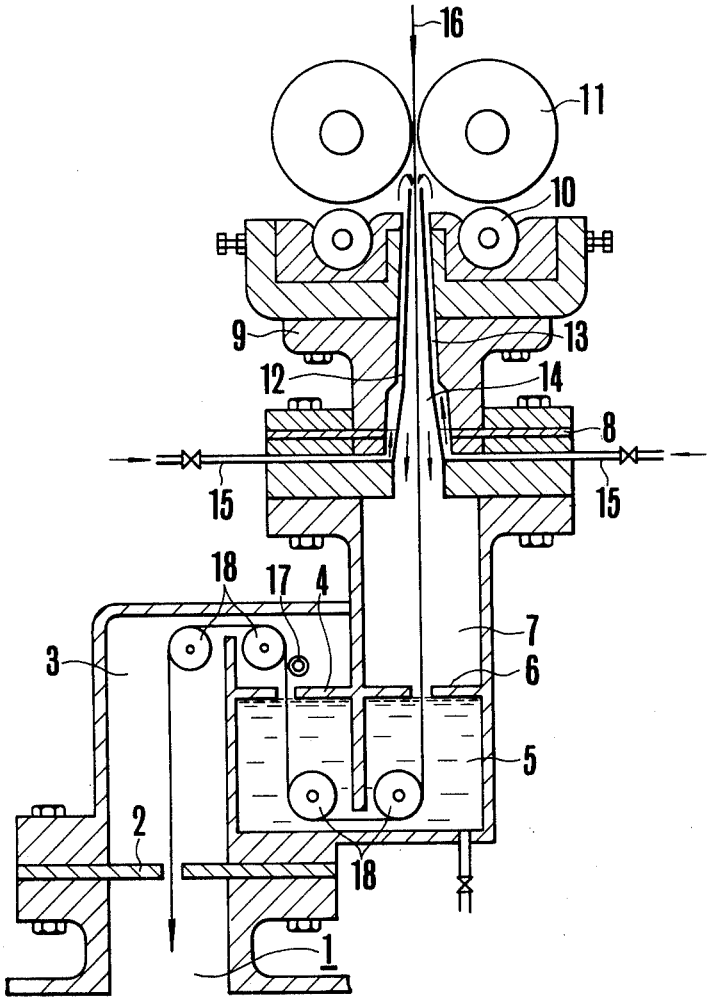
FIG. 2 is also a vertically sectional front view illustrating a modification of the device shown in FIG. 1 as an example.

FIG. 2 illustrates a modification example of the embodiment of the invented air sealing device of FIG. 1. This modification example features:

1. A liquid sealing chamber is provided in between an opening of the drum body of a high pressure steamer and an air sealing cylinder to prevent the air from coming into the drum body so that a saturated steam atmosphere inside the drum body can be maintained at a constant high temperature and a constant high pressure and also to prevent the high pressure steam from coming into contact with sealing rolls so that the surface temperature of the rolls can be kept from rising.

For textile products such as cloth web, etc., the method of treatment generally varies with the kind of such products and the purpose of the treatment. In carrying out such treatment, humidity is an important factor. With the conventional sealing roll arrangement, however, it has been difficult to apply a humidity higher than a certain level to such textile products that are being treated. Whereas, the use of the liquid sealing chamber permits the adjustment of liquid quantity and himidity as desired. In a process where, for example, one of two different kinds of fibers is to be left white while the other is dyed through a single bath dyeing process, it is desirable to carry out such a process at humidity higher than 100%. For such a process, it is an advantage that humidity can be freely adjusted in the liquid sealing chamber on the inner side of the sealing roll arrangement in accordance with this modification example.

2. The air sealing through the liquid sealing chamber can be facilitated by weakening the pressure of the high pressure steam with a throttling member (a valve seat) and by causing the weakened steam to flow into a steam pressure reduction cylinder.

3. With the liquid sealing chamber used as a textile product treating liquid chamber on its textile product inletting side, the textile product is introduced into the chamber in the original woven state of it, without having been impregnated with any liquid, to be treated there for scouring, bleaching, etc. by means of a treatment liquid such as a caustic alkali with the quantity of the treatment liquid adjusted to be suitable for the textile product.

Furthermore, on its textile product outlet side, the liquid sealing chamber serves as a cooling chamber. The treated textile product is thus washed with cold water in the liquid sealing chamber to lower the temperature of it before it exits through the outlet part of the sealing roll arrangement. By this, the textile product thus processed can be prevented from flattening as much as possible.

4. The air pressure for air sealing is introduced into an air sealing cylinder through a seal block. At the seal block the air pressure impinges on the surface of the seal roll arrangement. This serves to cool the seal rolls further. The air pressure which has cooled the seal rolls flows to the air sealing cylinder flowing in parallel with the surface of the textile product. This serves to keep the textile surface from vibrating and thus serves to eliminate the possibility of brashing the textile product with the walls of its passage.

In the modification example of the air sealing device combined with a liquid sealing arrangement, a steam pressure reducing cylinder 3 of a reversed U shape is connected to an opening provided in the upper part of a high pressure steamer 1 through a throttle valve seat 2. Another end of the pressure reducing cylinder 3 is connected to a U-shaped liquid sealing chamber 5 through a throttle valve seat 4.

The liquid sealing chamber 5 is connected to an air sealing cylinder 7 which is disposed on the chamber 5 through a throttle valve seat 6. A seal block 9 is disposed above the air sealing cylinder 7 through a gasket 8. Above the seal block 9, there are provided two intermediate rolls 10, which are separated from each other with one disposed on the right side and the other on the left side. The upper faces of the rolls 10 are in contact with two right and left seal rolls 11, which are disposed above the rolls 10 and are closely adjacent to each other.

The hole which vertically penetrates through the seal block 9 is divided by a vertical partition plate 12 into an air pressure supply passage 13 and an intermediate passage 14 for textile products. The lower end of the air pressure supply passage 13 is connected to an air pressure blowing-in port 15. The upper end of the air pressure supply passage 13 is interconnected with the upper end of the textile product passage 14 immediately below the seal rolls 11; while the lower end of the textile product passage 14 is connected to the air sealing cylinder 7.

The modification example described in the foregoing operates as follows: The air pressure which is supplied through the air pressure blowing-in port 15, air pressure supply passage 13, textile product passage 14, and the air sealing cylinder 7 is arranged to balance against the steam pressure reducing chamber 3 through the liquid column of the liquid sealing chamber 5.

The woven textile product 16 which has been introduced into the passage 14 through the nipping faces of the seal rolls 11 passes the air pressure in the steam pressure chamber 7 and then is impregnated with an aqueous solution of caustic soda while it moves round the guide roll 18 provided in the liquid sealing chamber 5. The liquid content in the textile product is then adjusted to a suitable degree through a self-pressing dewatering pipe 17 which is a dewatering arrangement utilizing the pressure difference between the pressure of the high pressure steamer and that of the outside. After this, the textile product or web further moves round the guide roll 18 of the steam pressure reducing cylinder 3 and comes into the high pressure steamer 1 through the throttle valve seat 2.

What is claimed is:

1. An air-and-liquid combined sealing device comprising a high pressure steamer, wall means mounted on said high pressure steamer, said wall means defining an enclosed passageway and having a textile product inlet into said passageway and a textile product outlet from said passageway into said steamer, seal rolls located at the inlet into said passageway and forming a seal for the passageway, said wall means comprising an air chamber adjacent said inlet, a second chamber at the outlet from said passageway into said steamer, and a liquid treating chamber located between and communicating with said air chamber and said second chamber, and said passageway extending serially through said air chamber, said liquid treating chamber and said second chamber for conveying a textile product from said inlet to said outlet and into said steamer.

2. An air-and-liquid combined sealing device for a high pressure steamer, the steamer comprising a cylindrical drum body with the cylindrical axis thereof arranged horizontally, said drum having an opening in the top thereof, walls mounted on the top of said drum body and forming a closure for the opening therein, said walls forming a treating liquid chamber and a separate water chamber located in side-by-side relation with each having an opening therein communicating directly with the interior of said drum body, said walls forming an air pressure chamber located above and in communication with said treating liquid chamber and said water chamber, a pressure sealing arrangement for said air chamber comprising a rubber roll mounted above said air chamber, a first and a second stainless steel roll each located below and in surface contact with said rubber roll with said first and second stainless steel rolls spaced angularly apart about the circumferential periphery of said rubber roll, an air pressure blowing-in port opening into said air chamber for supplying air to said air pressure chamber to provide a pressure in said air pressure chamber which is balanced with the internal pressure in said drum body, plates are provided one above the other in a multistage arrangement inside both said treating liquid chamber and said water chamber for the purpose of buffing pressure and accelerating air-liquid separation, a seal-pressing dewatering member located within said drum body, and a group of feed rolls arranged in upper and lower rows within said drum body.

* * * * *